United States Patent [19]

Smith, III et al.

[11] 4,247,107

[45] Jan. 27, 1981

[54] ELECTRONICALLY CONTROLLED ROADRACE SYSTEM WITH SOUND GENERATOR

[75] Inventors: Jay Smith, III, Pacific Palisades; Lawrence T. Jones, Playa Del Rey; Gerald S. Karr, Venice; Thomas H. Grimm, Manhattan Beach, all of Calif.

[73] Assignee: California R & D Center, Culver City, Calif.

[21] Appl. No.: 4,620

[22] Filed: Jan. 19, 1979

[51] Int. Cl.[3] ..... A63F 9/14; A63H 30/02

[52] U.S. Cl. ..... 273/86 B; 46/257; 46/1 K; 104/296; 104/305

[58] Field of Search ..... 273/86 R, 86 B, 85 G; 46/1 K, 202, 259, 257; 104/60, 295, 296, 305

[56] References Cited

U.S. PATENT DOCUMENTS

| | | | |
|---|---|---|---|
| 2,631,853 | 3/1953 | Haynes et al. | 46/259 X |
| 3,400,667 | 9/1968 | Case et al. | 173/86 R UX |
| 3,432,166 | 3/1969 | Goldfarb | 273/86 B |
| 3,467,311 | 9/1969 | Ernst | 273/86 B |
| 3,546,696 | 12/1970 | Waters et al. | 273/86 B UX |
| 3,572,711 | 3/1971 | Conklin et al. | 273/86 B |
| 3,831,172 | 8/1974 | Olliges et al. | 273/85 G |
| 3,970,309 | 7/1976 | Sato | 46/1 K X |
| 4,162,792 | 7/1979 | Chang et al. | 273/85 G |

*Primary Examiner*—Anton O. Oechsle
*Attorney, Agent, or Firm*—Jackson, Jones & Price

[57] ABSTRACT

An electronically controlled roadrace system with a sound generator for penetrating a variety of audible signals is disclosed. The system includes facilities for starting the race, counting and displaying laps completed for each car, computing and displaying fastest lap times and last lap times for each car, calculating and displaying the remaining fuel for each car, introducing random failures for each car, and randomly determining one of several failure modes. Apparatus for selectively powering and depowering each track, upon signal from a controller, is shown. Also shown is a novel apparatus for sensing completion of another lap by each car, and a track section of each car track which is selectively decoupled from the track power for performance of pit functions.

Other features and functions are disclosed.

39 Claims, 11 Drawing Figures

ELECTRONICALLY CONTROLLED ROADRACE SYSTEM WITH SOUND GENERATOR

BACKGROUND OF THE INVENTION

1. Field of the Invention

The field of the present invention is amusement devices, and in particular electronically controlled amusement devices.

2. Discussion of the Prior Art

As an amusement device, the model car racing systems have, for well over the past decade, generated an enormous amount of enthusiasm and commercial interest. As the interest in such devices has increased, so has the number of different systems for racing the cars, such as "slot" car, "slotless", steerable car and so on. Moreover, the tracks involved range from simple two car slot car tracks around a simple oval to multiple track pairs disposed through an assortment of curves and loops to increase the operating skill required to maintain the car on the track, the realism of the system and the consequent increase of enjoyment obtained by operation of the roadrace system.

Various commercial attempts have been made to improve the model roadrace systems of the prior art and to increase the realism of the model systems. For example, U.S. Pat. No. 3,531,118, issued to Mabie, et al. discloses an electronic lap counter for vehicular racing games. A light board is used to display the completed lap count.

Another attempt to increase the sophistication and realism of a roadrace system is shown in U.S. Pat. No. 3,572,711, issued to Conklin, et al. This patent discloses a system for counting laps completed, timing individual laps, the elapsed race time, and visually indicating these parameters to the operators.

U.S. Pat. No. 3,729,193, issued to Labis, illustrates an electronic horse racing game, wherein the speed of the horses is randomly varied. Display means for displaying the race odds and the race winner are disclosed.

Another pertinent reference is U.S. Pat. No. 3,970,309, issued to Sato, which illustrates a roadrace system with a pit section, which is branched from the main track section and which is utilized for literally recharging the batteries of the race cars.

While each of the above patents represents attempts to increase the sophistication and realism of the roadrace games, each falls quite short of providing a realistic race environment which includes car sounds, failure, race winner declaration and the like.

BRIEF SUMMARY OF THE INVENTION

An electronically controlled roadrace system is disclosed. The controller unit is coupled to a novel electrically isolated track section, and detects a car on the isolated track section for counting laps and computing lap times. Another track section is selectively electrically isolated by the car operator from the main track for each car, for performing "pit" functions, such as refueling and repair work. Only when the car is in the "pit" section and the track selectively isolated will the controller allow refueling or repair to occur.

The invention also comprises a power/failure display unit, and a sound generator unit. In the disclosed preferred embodiment, these units are housed in separate modules, but could as well be packaged as one unit with the controller unit. The power/failure display board receives control signals from the controller for selectively disabling the power to each track pair, and for displaying the appropriate failure mode or modes.

The sound module is coupled to the controller unit and the power/failure module for receiving control signals for generating a variety of sounds, for example, "gunshots", engine sounds for each car, and tones or "beeps" of selectable frequency.

The controller integrates and controls the operation of the other units. It also receives information from the race operators, such as instructions to commence race countdown, requests for last lap time display, fastest lap time display and display of remaining fuel level. The controller stores this information, and also randomly generates a failure lap for each car.

When a car either runs out of fuel or completes the number lap equal to the predetermined failure lap, the controller disables power to that car, and once the car has been placed in the pit area and the "pit" track section is electrically isolated from the main track section, will commence to "fuel up" or perform repair work in accordance with a randomly selected repair mode (which require varying repair times).

The controller also, prior to the race start, receives information setting the race length (in laps) for each car, thus allowing one car to have a race "handicap" with respect to the other. When a car has completed the required number of laps the controller declares a winner, via the displays and sound generators.

The system may also be operated in a "qualifying" mode, i.e. an uninterupted race of undetermined length, by starting the race without entry of race lengths to the controller.

In the preferred embodiment, the basic element of the controller is a microcomputer, the Texas Instrument TMS 1100, its read only memory configured to carry out the functions disclosed herein. Generally, the data inputs to the microcomputer are multiplexed into the same, and the computer controls two, two-digit LED displays (i.e. one such display for each car).

Other features of the invention are discussed.

DETAILED DESCRIPTION OF THE INVENTION

The present invention comprises a novel roadrace system including means for racing in a "qualifying" mode, setting predetermined race lengths for each of the cars in play, means for counting completed laps, means for displaying race parameters, means for generating a variety of sounds, including engine noises, car failure noises, a "winner's" time, gun shots, and variously pitched tones, means for randomly declaring a failure and/or low or empty fuel condition, means for refueling and/or repairing (electronically) failures, and means for cutting off or restoring power to each of the cars in dependence upon race conditions.

By introducing random failures, and by requiring a driver to keep track of his fuel level, coupled with means for displaying the lap count, fuel level, random failure mode, and means for generating sounds, the sophistication of the system is enormously increased in comparison with the prior art roadrace systems.

While the preferred embodiment is disclosed with reference to a two-car slot race track, the present invention may as well be adapted to other types of race systems for one or more race machines, and with other types of track systems. Thus, while the invention is discussed with reference to a preferred embodiment, the generality and scope of the disclosed invention is not to be limited to the particular embodiment shown.

Figure 1:
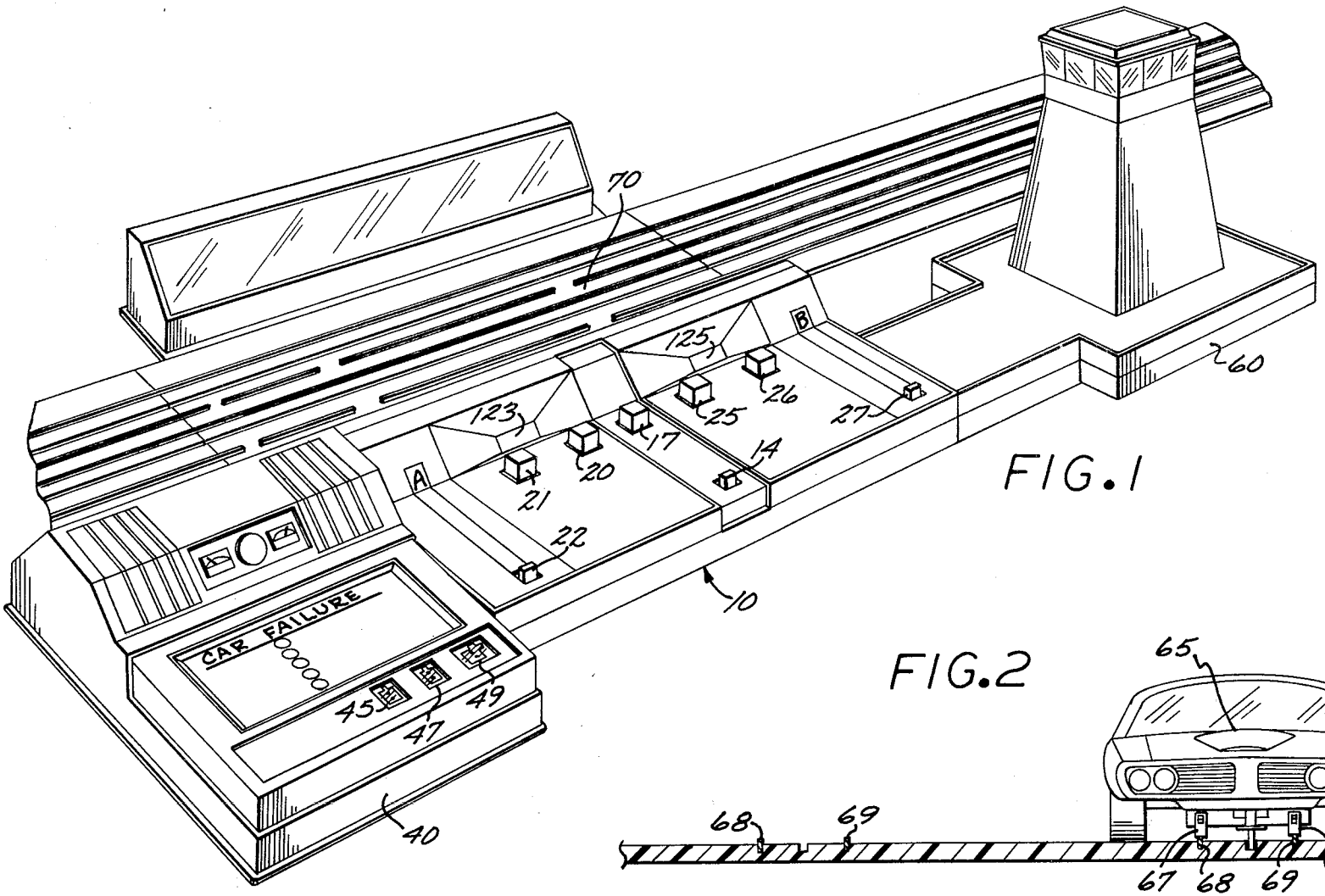
FIG. 1 is a perspective view of the preferred embodiment of the present invention.

Referring now to FIG. 1, a perspective view illustrative of the physical layout of the preferred embodiment of the invention is disclosed. While the complete configuration of the track is not shown, the present invention is adapted for use with all of the types of track systems used in model car races. In general, the track system may be configured in an oval or looped configuration or with various curves, hills and straightaways. The physical configuration of the preferred embodiment of the present invention comprises four separate components, the control module, sound module, power failure display module, and a "lap sensor/pit track" section. The control module is coupled to the lap sensor/pit track section, the power module is coupled to the control module and to the track for providing power thereto, and the sound module is coupled to the control module. Of course, it is not necessary in the practice of this invention to physically package the components for implementing the functions of the power, sound and control modules into physically separate modules; these modules could as well be packaged into one complete enclosure. However, it is contemplated that the power and sound modules may be sold as optional pieces of equipment, so that the purchaser of the roadrace system can purchase each of the modules separately if so desired.

As may be seen from FIG. 1, externally, the control module 10 includes two complete sets of switches and display panels, in addition to a system "on" switch and a "start" switch.

The car A switches are disposed on the left side of module 10, and comprise lap switch 20, fuel switch 21, and pit switch 22. Disposed above these switches is a two-digit numerical display 123. Similarly, on the right hand side of the control module 10 are disposed the car B switches, lap switch 25, fuel switch 26, pit switch 27, and above the switches, car B display 125.

The power module 40 is physically adapted to fit alongside the left side of the control module 10 and to have a plug-in connector for coupling thereto. The power module 40 includes three receptacle members, 45, 47 and 49, for receiving connectors coupling separately to the car A hand controller, car B hand controller and track power connections. Disposed in the top of the power module is car failure display board 55, including a plurality of display lights.

Receptacles 45 and 47 are connected to reostate hand controls, one for each of the car operators for varying speeds of the cars. These hand controllers are old in the art, comprising means for varying the voltage or current applied to the track, and therefore forms no part of the present invention. Receptical 49 furnishes a convenient point for connecting the track power supply.

The sound module 60 is disposed adjacent the control module 10 in its right side and is coupled to the control module 10 via a plug-in electrical connector (not shown).

Having described the physical layout of the preferred embodiment of the invention, the preferred embodiment will now be functionally described. The control module 10 controls the race and integrates the operation of the other modules. The sound module 60 provides countdown tones, a starting gun blast, engine noise, "low fuel" signal, and "out of fuel" signal, a "winner's" tune, a "European ambulance" sound (alternating high and low tones) and a car failure sound. As will be discussed herein below, all of these tones are software controlled.

The power control module, upon command from the control module, shuts off car power during the countdown, upon car failure, when the car is out of fuel, and finally, when the race winner has been declared. The failure display board on the power control module indicates, when a car is in the failure mode, the particular failure mode configuration of the car.

The roadrace system is enabled by actuation of the on-off switch 14 located on the control module. When the system is enabled, the displays are configured into a reset condition, with the least significant digit of each of the display blinking three horizontal bars. Turning switch 14 on serves as a system reset button.

Before the start of the race, the lap switch is used to set the length of each car's race. Each lap switch selects the length of the race for the car associated with that lap switch. Each switch must be operated to set the race lengths for both cars; thus, a race handicap may be included, allowing one car to be declared the winner after having completed fewer or greater numbers of laps than the other car. Each time the lap switch is actuated, prior to the start of the race, the race length is increased by five laps and displayed up to maximum race length of 95 laps. If these switches are not actuated prior to the start of a race, the length of the race will be undetermined, and no winner will be declared; in this mode, the players may race indefinitely. Failure to actuate the lap switches before the start of the race will also not enable either the car failure system or the fuel monitoring system, therefore allowing an uninterupted race of undetermined length. However, the number of completed laps will be displayed as usual. Thus, this mode may be used as a race "qualification" mode.

The start button is used to initiate the race countdown. Upon pressing the start button, a 10 second count down is initiated, during which are displayed sequentially in each of the player's displays, the count-down, 9, 8, 7, 6, 5, 4, 3, 2, 1, and then "go". If the sound module is connected, each number for the count-down is accompanied by a "beep" tone, and "go" is accompanied by a "gunshot" sound. If the power module is connected, the power to the cars will be cut off during the count-down, allowing the car throttle to be "revved up" (with the corresponding engine sound for each car sound), but eliminating any possibility for a premature start.

The lap sensor/pit track section 70, which is coupled to the control module 10, includes means for sensing when each car has completed another lap. This sensor comprises the highest priority input to the master control. At the time of actuation of the lap sensor by a particular car, the master control 10 determines, for that car, its fuel level, last lap time, fastest lap time, and end of race, and whether the low fuel, out of fuel or failure modes are applicable.

The starting line for the race is disposed immediately prior to the lap sensor. The first time the cars cross the lap count sensor, after the race has started, the lap count will be set at zero and displayed in each of the car displays at appropriate times. A driver that "jumps the count", when the power module is not connected, would therefore be penalized because the lap count sensor is not monitored by the control module until the start of the race.

During the race, the lap switches 20 or 25, when actuated will cause the corresponding display to show the time of the last completed lap for the car associated with that lap switch. A time-out of approximately ¾ of a second also begins and if the lap switch is actuated during this time-out, after ¾ second delay, the display will then show the fastest lap time for another ¾ second. This alternate display of last lap time and the fastest lap time may be continued indefinitely by repeated actuation of the lap switch. Upon the end of the time-out with no actuation of that lap switch, the display will revert to whatever it had been displaying prior to actuation of lap switch. Normally, the display shows the number of laps completed, but in other conditions it illustrates a failure condition, out of fuel condition or low fuel condition.

Actuation of the fuel switch for a particular car will cause the car fuel level to be displayed on the associated display (in gallons). This switch is also coupled with a ¾ second time out. The fuel level itself is based upon the number of laps completed and the lap time for each lap; the fuel consumption rate, as will be discussed below, increases with a decrease in the lap time. Initially, at the race start, each car is loaded with 90 gallons of fuel, and at speeds such that a lap time of less than 2 seconds is achieved, the fuel usage rate is 10 gallons per lap. At the lowest speed, greater than 10 seconds per lap, fuel usage is 10 gallons. For fuel times occuring between 2 and 10 seconds, the fuel calculation is computed on the following formula:

$$\text{FUEL} = \text{FUEL} - 12 + \text{Lap Time (in integers)}$$

If the remaining fuel for that car is zero gallons, the control module disables the power to that car (if the power module is connected) and display two dashes in the display of the affected car to indicate the out of fuel condition. The engine sound of the affected car is also disabled.

At the point when 18 gallons is calculated as the remaining fuel level for a particular car, a "lo" signal is displayed in a blinking mode alternating with the lap count to indicate that the car is running low on fuel. Also, if the sound module is attached, a "beep beep beep" warning will be sounded.

The pit switch for each car controls refueling and repair of that car when it is in the pit track section. The car must physically be located in the pit section and be in contact with the track rails for that car in order for the control module to sense the pit condition, ie. when both the pit switch is actuated and the car is disposed in the pit area. Whenever a car is in the pit condition, its engine sound will be disabled.

In order to "refuel" the car, the car must be in the pit section and the pit switch must be actuated (i.e. depressed) continuously, and will replenish fuel at the rate of 10 gallons per second, taking a total of 9 seconds to refuel an empty car. The sound module, if connected, will emit higher pitched "bleep" tones each time the least significant digit of the fuel level equals zero; and when 90 gallons are reached, a distinctive tone is sounded to indicate the refueled condition of the car.

The pit switch also serves to "repair" a car when failure occurs. The control module randomly sets up a car failure lap for each car, selecting a lap between 4 and 19 at random at the start of the race and at each pit stop. If the power control module is not connected, the failure mode is disabled and the race will continue without any car failure indicated by either sound or on the display.

When a failure occurs for a particular car, ie. by completion of the randomly defined number of laps, one of five failure modes is randomly selected and displayed on the failure display board and on the two digit display on the control module. On the failure display module, one of five LEDS will be lit next to a description of the failure and at the same time, the display for the effected car on the control module will show "FX", where "X" is the number of the failure mode as shown on the car failure display mode. The severity of the failure increases with increasing number of the display mode. For example, failure mode "I" is a tire change and requires a repair time of one second in the pit section. Failure mode 2 is a suspension tune requiring a two second repair time, 3 an oil leak requiring 3 seconds, 4 a turbocharger requiring 4 seconds and 5, an engine breakdown requiring a repair time of 5 seconds in the pit section.

Either car may fail in any mode at any time during the race. It is entirely possible that while one car is being repaired, the other may fail in the same or a different mode. If the failure mode were different, then the respective failure modes would be displayed on the display board and the appropriate failure mode displayed on the two digit displays of the control module.

At the time when a failure occurs, three short "explosion" sounds are heard, if the sound module is in place, and power to the affected car will be shut off if the power control module is attached. Repairs of failures occur only in the pit track section. As with refueling procedure, the car must be physically disposed in the pit track section in contact with each rail, and the pit switch continuously actuated. When the car is in the "pit" condition, the two digit display will, at one second intervals, display the original failure mode, decreasing one integer per second until zero is reached. Each time the failure mode changes, an increasingly higher pitched "beep" is sounded. One second after zero, the failure is considered repaired, and the same distinctive tone used for "full fuel" indication is sounded. When the pit switch is released, power and engine sound are restored to the car.

When the first car completes its predetermined number of laps that comprises the length, it will be declared the winner by the display blinking the number of the last lap, stopping the lap counting function, and if the sound module is in place, sounding a "charge" tune.

The fuel and lap buttons will continue to operate as during the race. If the power/failure module is attached, power to each car is cut off immediately upon the winner crossing the finish line.

Figure 2:
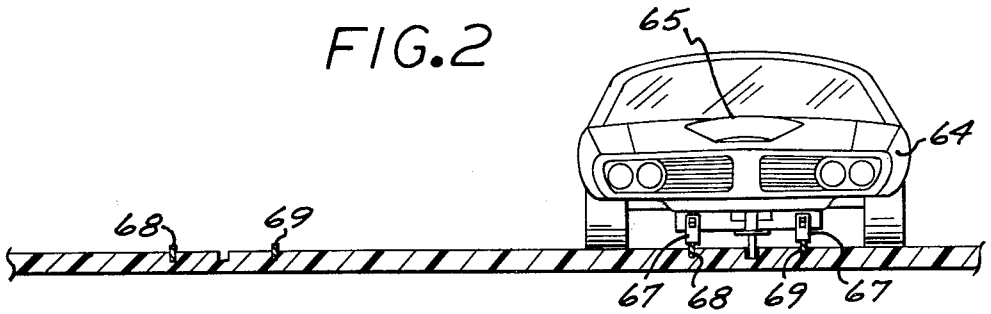
FIG. 2 is an end view of a model car disposed in position of a track pair of a roadrace system.

Reference to FIG. 2 illustrates a slot-car track system as typically used in roadrace systems, and a car 64. Each car 64 includes an electric motor 65 for propelling the car 64 by operating from the voltage differential maintained across the track rails 68 and 69. Thus, the car 65 includes a pair of conductive pick-ups tabs which contact the rails of the track pair.

Figure 3:
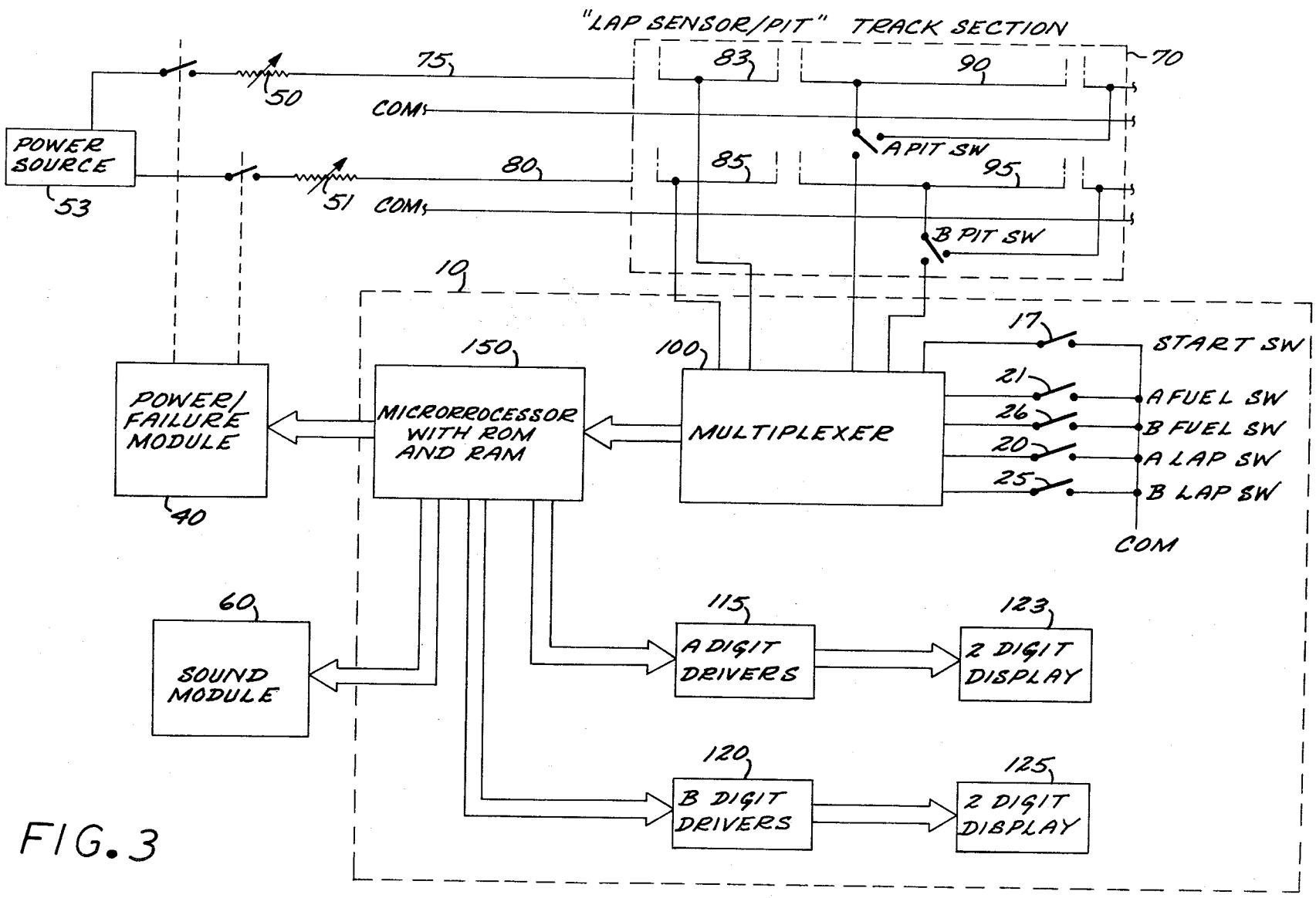
FIG. 3 is a block diagram and schematic drawing, illustrating the interconnections of the basic modules of the preferred embodiments, the major components of the control module and lap sensor/pit track section of the disclosed invention.

The above described operation of the system is implemented generally by the block diagram of the system shown in FIG. 3. The "lap count sensor/pit" track section 70, best shown in FIG. 3, comprises a novel feature of the present system. Lap sensor/pit track section 70 comprises a section of track which is compatible with the particular type of roadrace system used, i.e. slot car, slot-less, etc., and, in the embodiment shown, includes two track pairs, one pair for each of the cars. Each track pair includes a "common" rail with the track pair for having hot rail 80. Three interruptions in each of the three hot rails for tracks A and B are defined by track section 70 and are shown in FIG. 1 and schematically indicated in FIG. 3. These interruptions comprise physical interruptions in the "hot" rails or gaps between the three defined sections of the three hot rails. Thus, for hot rail 75, these interruptions define the lap sensor section 83, and pit section 90. Similarly, for hot rail 80 (Car B), the rail interruptions define the lap sensor section 85 and pit section 95. Each of the interruptions comprises a one half inch gap or separation, while rail sections 83 and 85 have an approximate length of about 4 to 5 inches, and sections 90 and 95 have approximate lengths of 8 inches. These dimensions are dependent upon the particular size of the model car utilized and for a toy race car of the slot or slot-less variety, these dimensions are appropriate. The size of the rail separations are chosen to prevent any shorting together of the sections of the hot rails by the conducting pick-up tabs of the car. The length of the lap sensor section is chosen to ensure that the car will spend sufficient time on the sensor section for the control module to sense the car thereon, the length 4 and 5 inches providing ample length to insure that at some point, the car will be making contact with both rails of the lap sensor section when this section is monitored by the control module. The length of the pit section is again chosen as simply a convenient length; the length 8 inches allows ample room to maneuver the car thereon and is compatible with a convenient length for the track section 70.

Before describing the electrical configuration of track section 70, it is noted that the general components of the control module are indicated within the phantom line designated by numeral 10 in FIG. 3, and comprise multiplexer 100, for multiplexing a variety of inputs for entry into microcomputer 150. Microcomputer 150 controls digit drivers 115 and 120. These digit drivers in turn drive LED two-digit displays 123 and 125. Microcomputer 150 also is coupled to the power failure module and the sound module. The microcomputer 150 utilized in the preferred embodiment has only four separate data input lines, and since there are more than four data inputs to the microcomputer 150, multiplexer 100 is required to multiplex the various inputs for appropriate entry in to the microcomputer 150.

Again referring to FIG. 3, rail section 83 is coupled, via appropriate buffering circuitry not shown, to the multiplexer 100. Similarly, track rail section 85 is also connected, via appropriate buffering circuitry not shown, to the multiplexer 100. Pit rail section 90 is coupled via switch 22 either to the multiplexer or to main rail section 97, depending upon the position of switch 22. Similarly, rail section 95 is coupled via pit switch 27, either to the multiplexer 100 or main rail section 98.

Thus, rail sections 83 and 85 are isolated from corresponding "hot" rails and are therefore not powered at any time. Pit sections 90 and 95 may be selectively electrically isolated from the corresponding hot rail 97 or 98 by appropriate actuation of the pit switches.

A typical model car may be electrically modeled as a resistance of about 10 ohms in series with the inductance of the motor armature. Thus, when a car passes onto the lap sensor track section, or the pit section, the appropriate rail section 83, 85, 90 or 95 will be coupled to the common rail through a 10 ohm resistance and some inductance. (In the case of the pit section, this coupling will occur only when the pit switch is actuated to disconnect the pit section from the "hot" rail and couple the rail of the pit section to the multiplexer). Since rails 83, 85, 90 and 95, in appropriate switch configurations, are coupled to the multiplexer, a "true" signal will be generated when the car is in the lap sensor or in the pit section. These signals are multiplexed into the microcomputer 150 which then receives the information for processing. Thus, under the appropriate conditions, the lap count sensor/pit track section provides information to the microcomputer 150, informing it of the presence of a car on the lap sensor section or pit track section.

The track section 70 coupled with module 10 provides a novel means for detecting the presence of a car on a section of rail which is both reliable and inexpensive. In particular, the prior art mechanical means for counting laps are unreliable in that they sometimes deflect a car from its track, or may fail to register the properly completed lap. Prior art methods utilizing electronic or electrical components have utilized such means as coil members disposed beneath the track section, so that the metal part of the car passing thereover induces a signal within the coil which is then detected by the appropriate signal processing circuitry. However, the presently disclosed apparatus requires neither extensive moving mechanical parts nor electric coils, and is compatible with slotless and steerable systems as well.

Having described the overall configuration of the system and the lap count sensor/pit track section the circuitry of the preferred embodiment will not be described. First referring to FIG. 4, the circuit schematic of the control module and the track section 70, is disclosed. As noted above, the invention need not be divided into three modules but rather the circuitry disclosed in FIGS. 4, 5 and 6 may be combined within a single package.

The control module comprises the microcomputer 150, two two digit LED display units 123 and 125, a dual two-wide two-input AND-OR-INVERT gate which serves as the input multiplexer 100, LED drivers 115 and 120 for driving the displays, and associated circuitry. In the preferred embodiment, a Texas Instrument TM 1100 microcomputer is utilized. While other commercially available microprocessor and microcomputers may be used, the TMS 1100 is particularly well adapted to the present invention in that as a one chip microcomputer, it includes on the same chip, inter alia, a read only memory, random access memory and LED segment controllers, and therefor eliminates the need for additional discrete chips to be hard-wired to the microprocessor. The present invention has also been practiced using a Motorola 6802 microprocessor chip; however, other necessary components included on the TMS 1100 chip, such as the random access memory, the read only memory, and the display segment controllers, must be included as additional discrete elements. The Texas Instrument TMS 1100 microcomputer is completely described in the "TMS 1000 Series Data Manual", December 1976 edition, published on behalf of Texas Instruments, Incorporated; at page 15 of this manual, a block diagram of the logic blocks contained within this microcomputer is shown and incorporated herein by reference.

Since the TMS 1100 accepts 4-bit data words, and the number of input signals to the microcomputer 150 exceeds 4, a multiplexer is utilized to multiplex the various input signals into the microcomputer. As explained more fully in the referenced data manual, the characteristics of the TMS 1100 are such that the microcomputer has four "K" data input terminals, denominated "K1 through K4" in FIG. 4, eleven "R" output (or "instruction bit") terminals R0 through R10, and eight "O" outputs, O0 through O7, for controlling the segments of a 7 segment display, plus decimal point.

The multiplexing unit utilized in the preferred embodiment of this invention is the RCA CD 4085, a dual, two-wide, two-input, AND-OR-INVERT gate. Other similar commercially available units might as well be used. Two data inputs to the multiplexer 100 comprise one terminal each of switches 22, 27. These switches comprise single pole, double throw slide switches. These terminals are respectfully coupled into the multiplexer 100, through protective resistors R18 and R20, (R18 and R20 may be 100 K ohms). Rail sections 83 and 85 of the lap sensor track sections are additional data inputs into the multiplexer 100 being coupled through resistors R63 and R64, (which are diode-protecting, current limiting resistors of 1 K ohms), diodes D2 and D3, and protective resistors R11 and R13, respectively (R11 and R13 may be 100 K ohms).

One terminal each of fuel switch 21 and lap switch 20 are connected at node 202, which node in turn is coupled as another data input into the multiplexer 100. Switches 20, 21, 25 and 26 comprise single pole, single throw switches; the preferred embodiment utilizes switches manufactured by Amp, Inc. Similarly, one terminal each of lap switch 25 and fuel switch 26 are coupled together at node 104 which in turn is coupled to the multiplexer as an additional data input 101. The multiplexer data outputs 110 and 111 respectively are coupled into the K1 and K2 data inputs of the microcomputer 150 through logic inverters 112 and 113.

Another data input, K3, into the microcomputer 150 is provided by one side of start switch 17. The other side of start switch 17 is connected to the R6 output terminal of the microcomputer 150.

Referring now to two-digit displays 123 and 125, in the preferred embodiment, these comprise 0.3 inch, 7 segment, common cathode LED displays. While these displays are commonly commercially available, in either single digit or double digit packages, in the preferred embodiment each display comprises a two-digit single package LED display manufactured by Quainco, 21 Austin Avenue, Tsim Sasha Tsui, Hong Kong. Thus, in FIG. 4, the notation "LH CATH" inside each display 123 and 125 refers to the cathode on the left hand digit of the display; similarly "RH CATH" refers to the cathode of the right hand digit. Each of the cathodes of the displays are driven by an inverting MOS to LED driver Ser. No. 75,492, which includes on the same chip drivers 126, 127, 128 and 129 as well as inverters 112 and 113.

One of the desirable features of the TMS 1100 microcomputer is that it includes an additional eight "0" outputs which are adapted for controlling the segments of an LED display. As show in in FIG. 4 the "0" outputs of the microcomputer 150 are coupled through current limiting resistors R1 through R8 (each may be 330 ohms) to the segment control inputs of both display. Although control signals 00–07 simultaneously drive the segment control inputs of both displays 123 and 125, the cathode of only one digit of one display is driven at any single instant of time. Thus, the microcomputer controls the segments of the displays via the "0" outputs, and controls the display cathodes (i.e., turning the displays on and off, via "R" inputs). (Each digit is scanned many times per second.)

R outputs R7 through R10 are control signals, or instruction bits, which are coupled into the sound module for controlling various sounds produced by the sound module. For example R10 controls the "beep" sound, R9 controls the "gunshot" sound, and R7 and R8 disable the engine sounds for cars A and B.

The fourth data input to microcomputer 150, K4, comprises a sensing signal from the power/failure module 40 indicating to the microcomputer 150 whether or not this optional module is connected. R inputs R5, R2 and R6 are also coupled to the power/failure module, R5 and R2 as control signals for switching on or off the track pair voltages, and R6 as an enable signal which enables the failure display board on the power/failure module. Also, five "0" outputs, 03, 04, 05, 06 and 07, are coupled to the power/failure module as control signals for the five LED displays.

Figure 4:
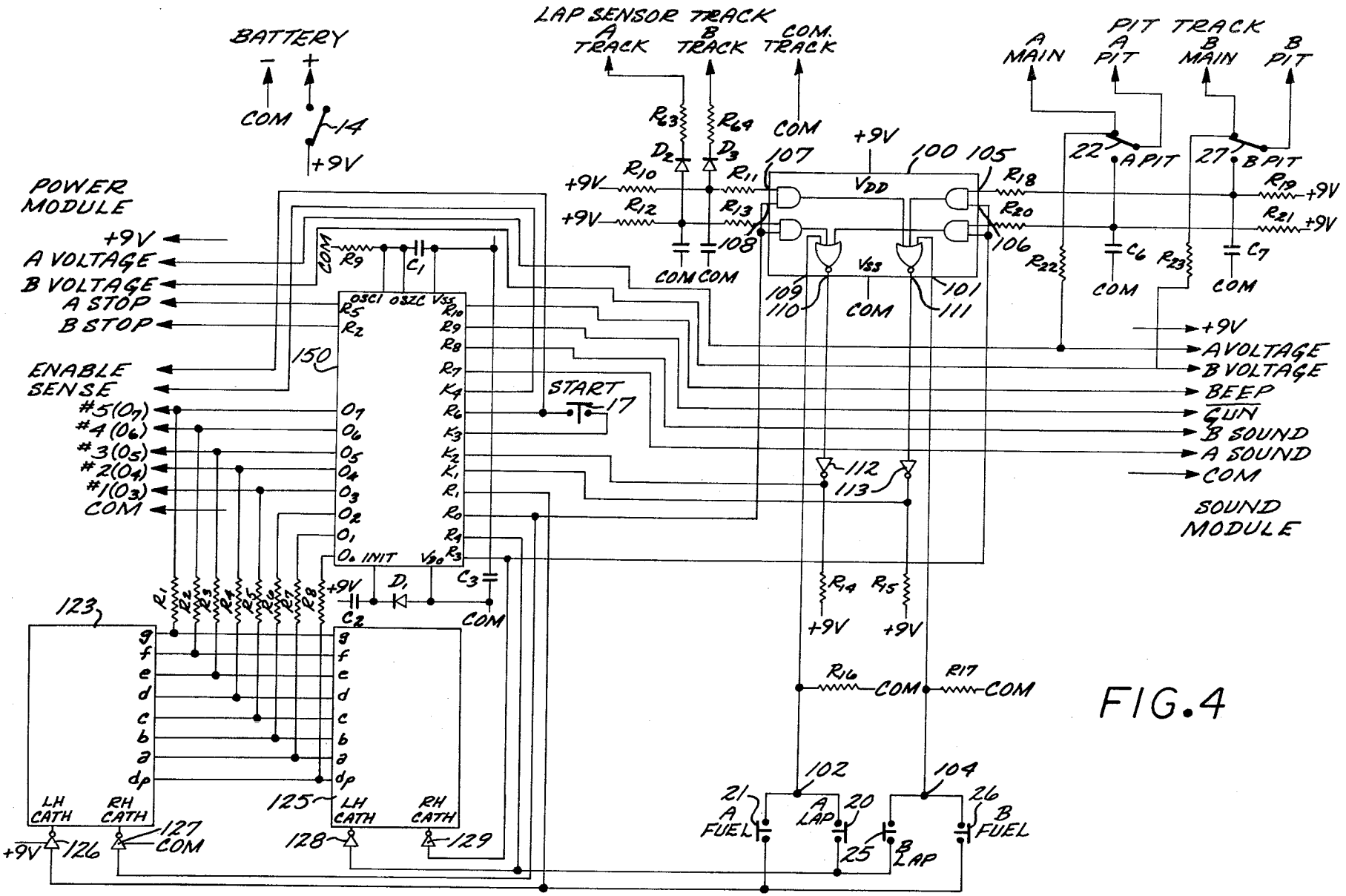
FIG. 4 is a schematic drawing of the control module of the preferred embodiment of the present invention.

Also as shown in FIG. 4, resistor R9 (47 K ohms) and capacitor C1 (47 ohms) together comprise the clock generator RC time components. Diode D1 connected across terminals $B_{dd}$ and "initialize" of the microcomputer 150 serves as a protective device.

Having described the components of the control module 10, the specific functions of the circuit may now be described in greater detail. Since the circuit is redundant in that identical separate circuitry is provided to independently monitor and control cars A and B, only the circuit components relating to car A need be described. Referring now to node 102, at which one terminal each of fuel switch 21 and lap switch 20 are coupled, the other sides of these switches are coupled respectively to R outputs R1 and R4 of the microcomputer 150. Thus, when both R1 is high and fuel switch 21 is closed, a "high" input to the multiplexer 100 at input 109 is generated. In order for input 109 to be "high", both the fuel switch must be activated and R1 must be high; this is accomplished during the program operation. Similarly, input 109 to the multiplexer 100 may receive a "high" signal due to closure of lap switch 20 and the "high" condition of the R4 output of the microprocessor 150. The microprocessor program will not place outputs R1 and R4 in the "high" position at the same time; therefor, an additional multiplexing function is achieved to further limit the number of required data inputs to the microcomputer 150. Within multiplexer 100, data input 109 is coupled through a "NOR" gate which will give a "low" output if any one of the three inputs to this gate are high. Thus, when a "high" input 109 to the multiplexer occurs, output 110 is in the "low" condition. The "low" output 110 is inverted to the "high" condition by inverter 112 and therefor a "high" data input signal is received by the microcomputer 150 at input terminal K2. Thus, when R1 is "strobed" or placed in the "high" condition, during the program operation, and the fuel switch 21 is closed, a high input signal at K2 will be detected informing the program logic that the fuel switch is closed.

The lap count and pit switch sensors generate "low" true signals, as compared to the "high" true signals generated by the other data signals. For example, lap count rail section 83 is coupled, via diode protective resistor R63 (which may be 1 K ohm), diode D2 (IN 4148, serving to reject any back EMF of the car motor), and protective resistor R11 (which may be 100 K ohms) to input 107 of the multiplexer 100. Also, resistor R12 (which may be 1 meg ohms) and capacitor C4 which may be 0.2 microfarads), comprise an RC network having a time constant of about 1/10 sec; this RC network will preserve the low "true" signal for about 1/10 second to ensure that the microcomputer software will have time to sense the true signal.

Thus, when the car is in contact with rail 83 and the common rail, rail 83 will be coupled to common through a small resistance and inductance, Node 72, normally held "high" by the positive nine volt supply, will be pulled down to a "low" voltage when the car is in position across rail 83 and common, which "low" condition will be held by the RC network at least 1/10 second. When R3 is high, and terminal 108 of multiplexer 108 is "low", multiplexer output 110 will be "low", and upon inversion by inventor 112, the K2 input to microcomputer 150 will be "high".

With respect to the sensing of the pit section, the circuitry operates in similar fashion to that for lap count sensing, except that rejection diodes and associated protective resistors are not required. Resistor R20 may be 1 megohm, and capacitor C6 0.1 micorfarad.

As previously mentioned, the displays 125 and 127 are controlled by R outputs R0, R1, R3 and R4 which are inverted and amplified by drivers 126, 127, 128 and 129 to provide the drive voltage to the cathodes of the display 123 and 125.

From the above description and examination of FIG. 4, it has been shown that the microcomputer 150 received multiplexed input data signals from the fuel, lap, and pit switches, from start switch 17 and a sensing signal from the power/failure module. This information is processed in accordance with the program contained within the read only memory of the microcomputer 150 and certain control signals are generated by the microcomputer 150 as a result thereof. These control signals control the display 123 and 125, provide control signals to the sound module and to the power/failure module to accomplish the functions hereinabove described.

Figure 5:
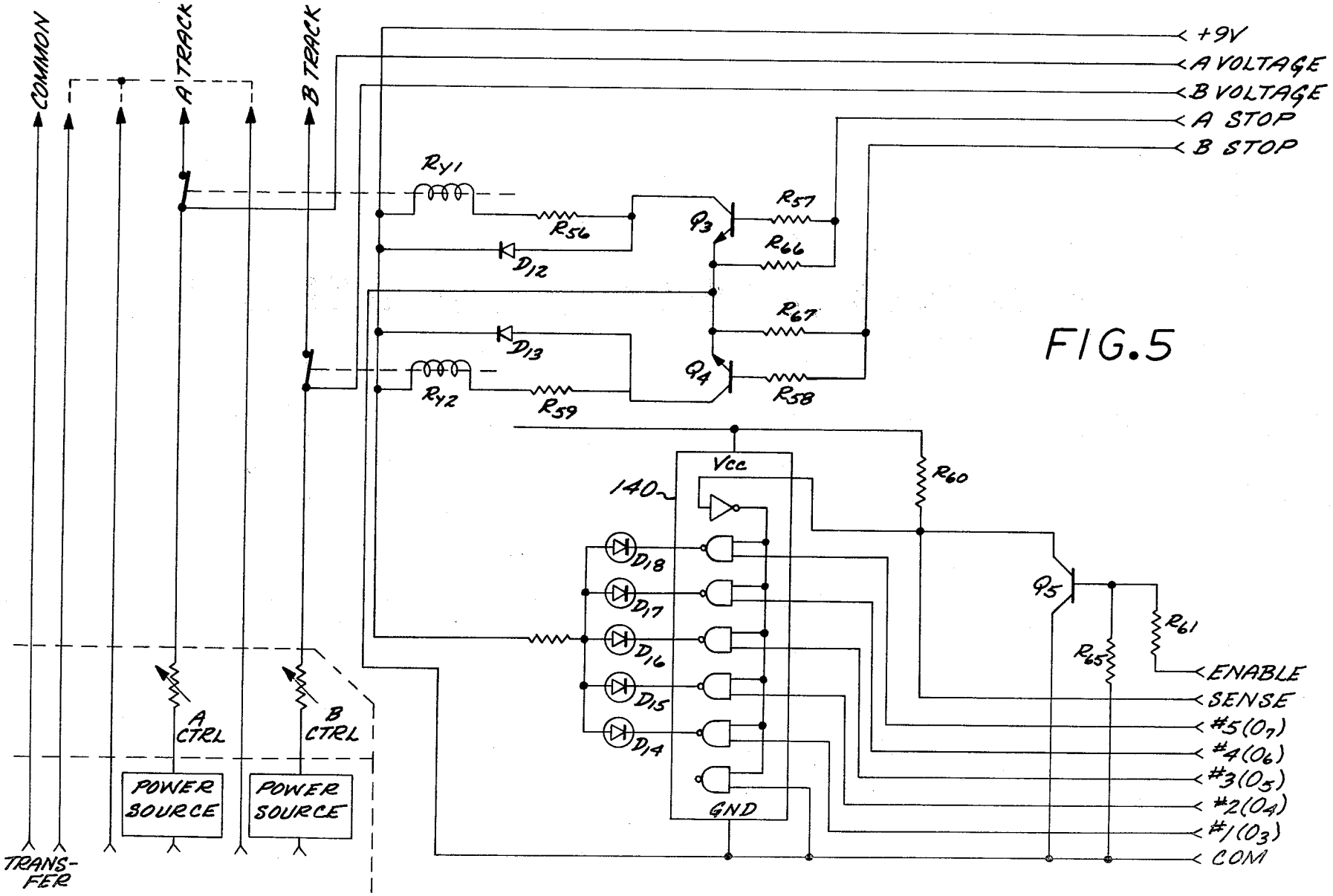
FIG. 5 is a schematic drawing of the power/failure module of the preferred embodiment of the present invention.

Referring now to FIG. 5, the power/failure module 40 schematic will now be described. As indicated, there are five input signals to the power/failure module 40 from the control module which controls the power functions and the failure display board of the power/failure module 40. One input line provides a plus 9-volt DC voltage; two other lines, microcomputer outputs R5 and R2, are control signals which control relays to selectively power and depower the track voltages for the two track pairs. Transistors Q3 and Q4 (N 3904) comprise relay drivers which, when turned on by the control signals R2 and R5, drive relays RY1 and RY2.

Relays RY1 and RY2 may be of the single pole, single throw variety, or single pole, double throw, and in the preferred embodiment Potter and Brumfield relays, Model number R50-E2-Y1-6V are used. In their normally closed conditions, relays RY1 and RY2 provide continuity between the hand controller units 50 and 51 (i.e., the variable resistence controllers) and the respective "hot" rails of the track pairs. As is shown in FIG. 5, the outputs of the hand controller units before the relays, are also coupled through the control module 10 and supplied to the sound control module for producing engine sounds proportional to the track voltage. Thus, even if one of the normally closed relays is opened, disabling the track voltage, the car may still be "revved", i.e., the sound module will still receive a signal proportional to a voltage output of the hand controller units. Diodes D12 and D13 serve as protective devices for the relay driver circuit.

Referring now to the portion of the circuitry concerning the failure display board, the display board comprises a set of red light emitting diodes (Monsanto MV 5023) which are driven by LED driver 140 for additional intensity. Driver 140 comprises, in the preferred embodiment a Texas Instrument 75494 MOS-to-LED segment and digit driver. The digit driver 140 is enabled or turned on by the enable control signal R6, from the microcomputer 150. Since the particular inverter chosen requires an enable "low" signal, transistor Q5 (2N 3904) is used as an inverter. Control signals 03, 04, 05, 06 and 07 from the microcomputer 150 control the separate LED drivers contained in driver unit 140. Thus, for example, when 07 is high, light emitting diode D18 (number 5) will be turned on to indicate failure mode condition number five.

As previously mentioned, data input K4 of the microcomputer 150 is utilized to sense the presence of the power/failure module. When the failure module is connected, K4 is coupled through resistor R60 (10K ohms) to the positive 9 volt signal provided to the power/failure module 40 by the control module 10. Thus, only when the power/failure module is connected will input K4 sense a positive voltage. This completes the description of the power/failure module.

Figure 6:
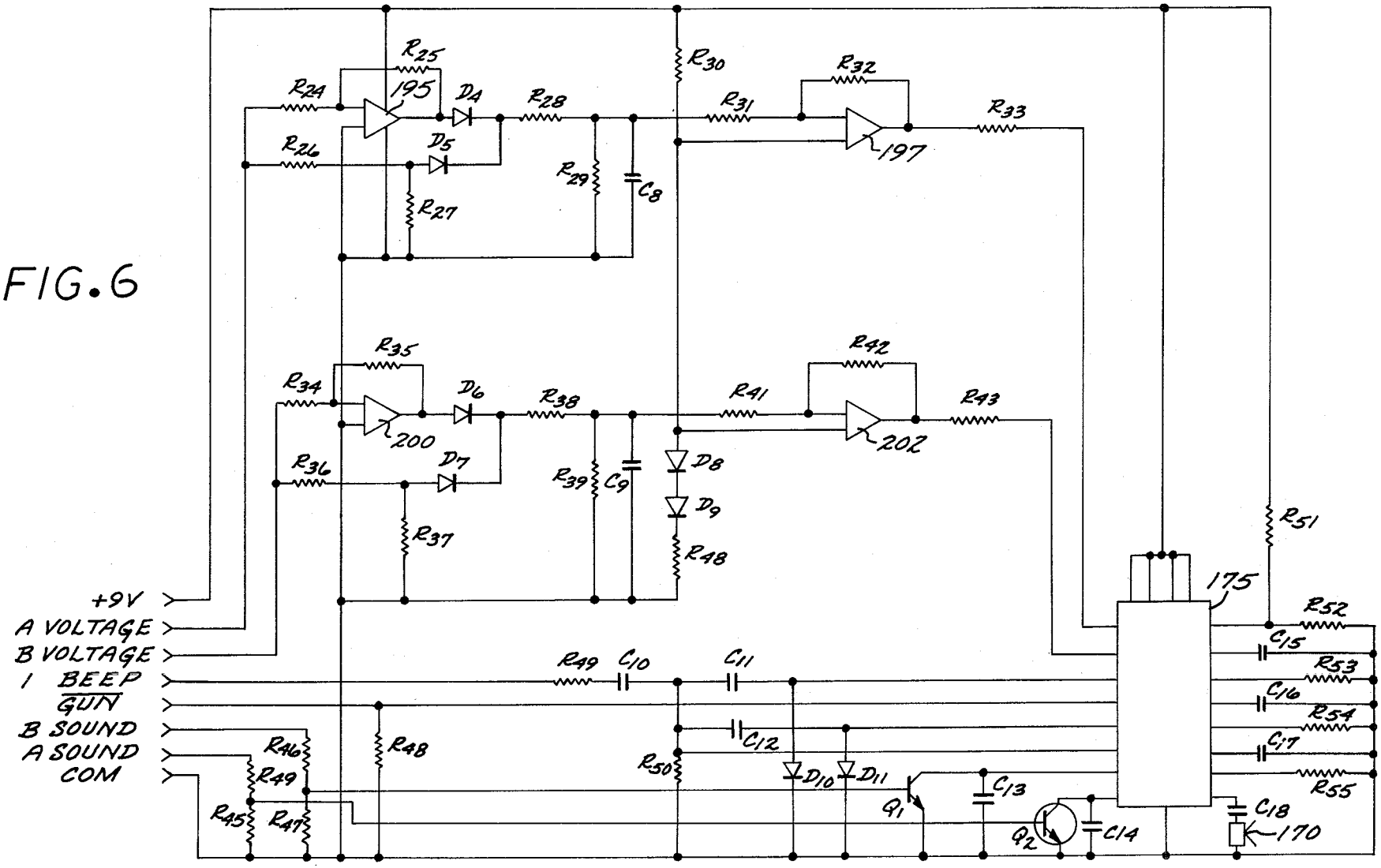
FIG. 6 is a schematic drawing of the sound module of the preferred embodiment of the present invention.

Referring now to FIG. 6, the schematic diagram of the sound module is shown. The function of the sound module is to produce a variety of sounds, including tones of software generated frequency, a "gun shot" sound, and engine sounds. Sound production is generated by sound chip 175 and conventional speaker 170 of nominal 8 ohm impedance. Sound chip 175 is an integrated circuit manufactured by Texas Instruments, TMS 76488 which includes inter alia, the speaker amplifier, two voltage controlled oscillators (VCO) and a noise generator. The voltage controlled oscillators of the sound chip 175 are utilized to produce the engine revolution noises which are proportional to track voltage.

As previously noted, the outputs from the players hand controller units 50 and 51 are coupled from the power module to the sound module. Since, depending upon the type of track, the track voltage may either by DC or AC, and since it is desirable that the present invention be adapted for utilization with either type of voltage, a full wave rectifier circuit is included in the sound module electronics to provide rectification of the track voltage. The voltage from the controller A is coupled to op amp 195 through protective resistor R124 (which may be 100 K ohms); op amp 195 has feedback resistor R125 (47 K ohms) associated therewith. Diode D4 (IN 4148) is coupled in series with the op amp 195. Coupled in parallel with the series circuit of diode D4 and op amp 195 are protective resistors R26 (100 K ohms) and diode D5 (also IN 4248). A filter comprised of the parallel circuit R29 (100 K ohms) and capacitor C8 (10 microfarads) is coupled in parallel across the resistor output of the rectifier. This time constant of this filter acts to produce a "throttle lag" in the engine sounds to increase the realistic effect of the sound. The output from the "throttle lag" filter is in turn coupled into op amp 197 which acts as a buffer to produce the appropriate signal level to the sound chip 175.

Similarly, op amp 200 and op amp 202, with their associated circuit components provide the similar function of full wave rectification, introduction of throttle lag, and buffering for processing the voltage on the second track. Op amps 195, 197, 200 and 202, in the preferred embodiment are contained on a single integrated circuit, an LM 324 quad op amp.

Another sound produced by the sound module is a tone or "beep" of variable pitch, which is generated directly by the microcomputer 150 as a square wave tone of variable frequency on output R10. The frequency of the square wave is controlled by the microcomputer 150, in dependence upon the race and car configuration, e.g., the "charge" tune, the "ambulance" sound and variously pitched tones. As shown in FIG. 5, the "beep" output from the microcomputer 150, R10, is "mixed", via resistors R29 (100K ohms), capacitor C10 (0.1 microfarad), capacitor C11 (0.05 microfarad), capacitor C12 (0.05 microfarads) and voltage dividing resistor R50 (2K ohms) with the output from each respective voltage controlled oscillator. The resulting mixed signal is fed into the audio amplifier input of sound chip 175.

Another sound produced by the sound module 70 is a "gunshot". This sound is controlled by the output R9 on the microcomputer so that whenever R9 is high, a gun shot is sounded.

Outputs R8 and R7 of the microcomputer are control signals for turning off the engine sound for each of the cars. Output R7 controls clamping transistor Q1 which, when turned on, clamps off the input voltage of the voltage controlled oscillator utilized to produce the engine sound for car A. A similar function is accomplished by R7 and clamping resistor Q2 (2N 3904).

Referring to the capacitors and resistors coupled directly from various terminals of the sound chip to the common line, the time constants for the various sounds produced by the sound chip 175 are controlled by these components. (Reference is made to the Texas Instrument data sheet for this chip for further information). Thus, by changing the components, and the time constants, different noise characteristics may be obtained.

While the circuitry and operation of the present invention have been described, the microcomputer 150, of course must be programmed to accomplish the functions described above. FIGS. 7–11 set forth a program flow chart which will accomplish, in conjunction with the disclosed circuitry preferred embodiment, accomplish each of the above enumerated functions. In the flow chart set forth in FIGS. 7–11, certain of the "boxes" contain certain "R", "K" and "O" numbers in parentheses. These R, K and O numbers are correlated to the schematic drawing of FIG. 4 and comprise the operative terminals of the microcomputer 150 for carrying out the function within that particular box. If the box has no parenthetical numbers, then the operation within the box is carried out within the program without external inputs or outputs. Moreover, the flow chart set forth in these drawings. may be programmed into the appropriate machine language microprocessors for various commercially available by a programmer skilled in the art. Thus, the flow chart of FIGS. 7 through 9 and obvious and routine modifications thereof, not only to the TMS 1100 microcomputer but may be applied in a program to other microprocessors such as the Motorolla 6802. Also, the flow chart shown generally contains only reference to one car, Car A, after the race start. Since the same program logic would be used for the other cars, it is not set forth in duplication. The program may simply perform all functions for Car A, and then for Car B.

Figure 7:
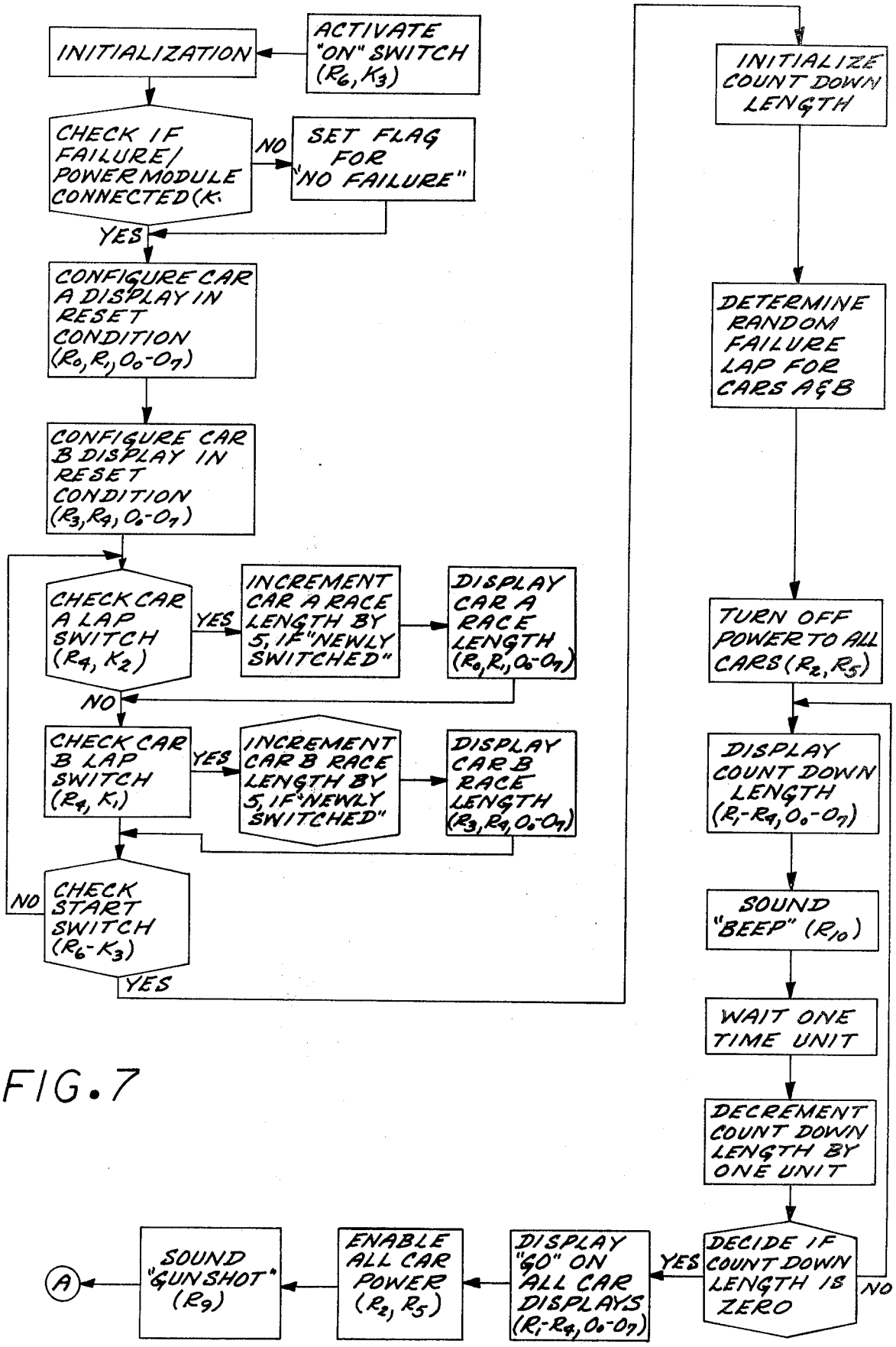
FIGS. 7, 8, 9, 10 and 11 comprise a program flow chart for implementing the basic functions of the microcomputer.

Reverring now to FIG. 7, the program is initiated by actuation of the "ON" switch. When ON switch 17 is actuated, a supply voltage of 9 volts is coupled to the microprocessor to provide a supply voltage. Upon actuation of the switch, initialization of the various parameters and program parameters is effected. Next, each of the two car display units is configured in a "reset" condition, which comprises placing three horizontal bars " " in the seven segment displays.

The next function is to check the lap switch 20 for car A to determine if it is closed. If switch 20 is closed, the race length for car A is then incremented by five laps, if the switch has been "newly switched". Since the repetition rate of the program is extremely fast with respect to human movement, means for determining that the switch has been lifted and re-closed must be built-in, otherwise a single closure will be sensed as a new "increment" signal almost instantly. Various methods can be used to implement this in the program and accordingly, will not be described further herein. After incrementing the race length, the race length for car A is displayed in the two digit display 123 corresponding to car A. The car B lap switch is then checked, and if newly closed, the race length is incremented and the car B race length displayed in display 125 corresponding to car B.

The "start" switch 17 is then checked to determine if it has been closed; if not, the program branches back to begin checking the lap switches again. If the start switch 17 has been closed, a countdown is initiated, the failure lap for each car is randomly determined, and the power to each track is turned off.

With reference to the determination of the failure lap, there are many software methods by which a number may be randomly selected. Since the random member generated is an integer from 4 to 15 laps, it has been found convenient to utilize a four bit register (which has a range from 0–15) within the microcomputer, the TMS 1100, and to increment this register once during each pass through the main program. When the contents of the register are read, the resultant number is the failure lap (except that when the register is "0", 4 is added). Since the scan rate is fast, and the particular instant when the random number will be called is not defined, the resulting number is sufficiently "random" to meet the requirements of the present invention. A similar technique may be utilized to generate the random failure mode.

Next, the countdown length is displayed beginning at the number 9, a tone or "beep" is sounded, there is a wait of one second, and the countdown length is not zero, the program branches back to the point of which the countdown length is displayed, a "beep" sounded, with the one second wait and the countdown decremented, until the countdown reaches zero. When the countdown length reaches zero, each of the car displays shown the word "GO", the track power is enabled, and a "gunshot" is sounded by the sound module. The race has thus been initiated.

Figure 8:
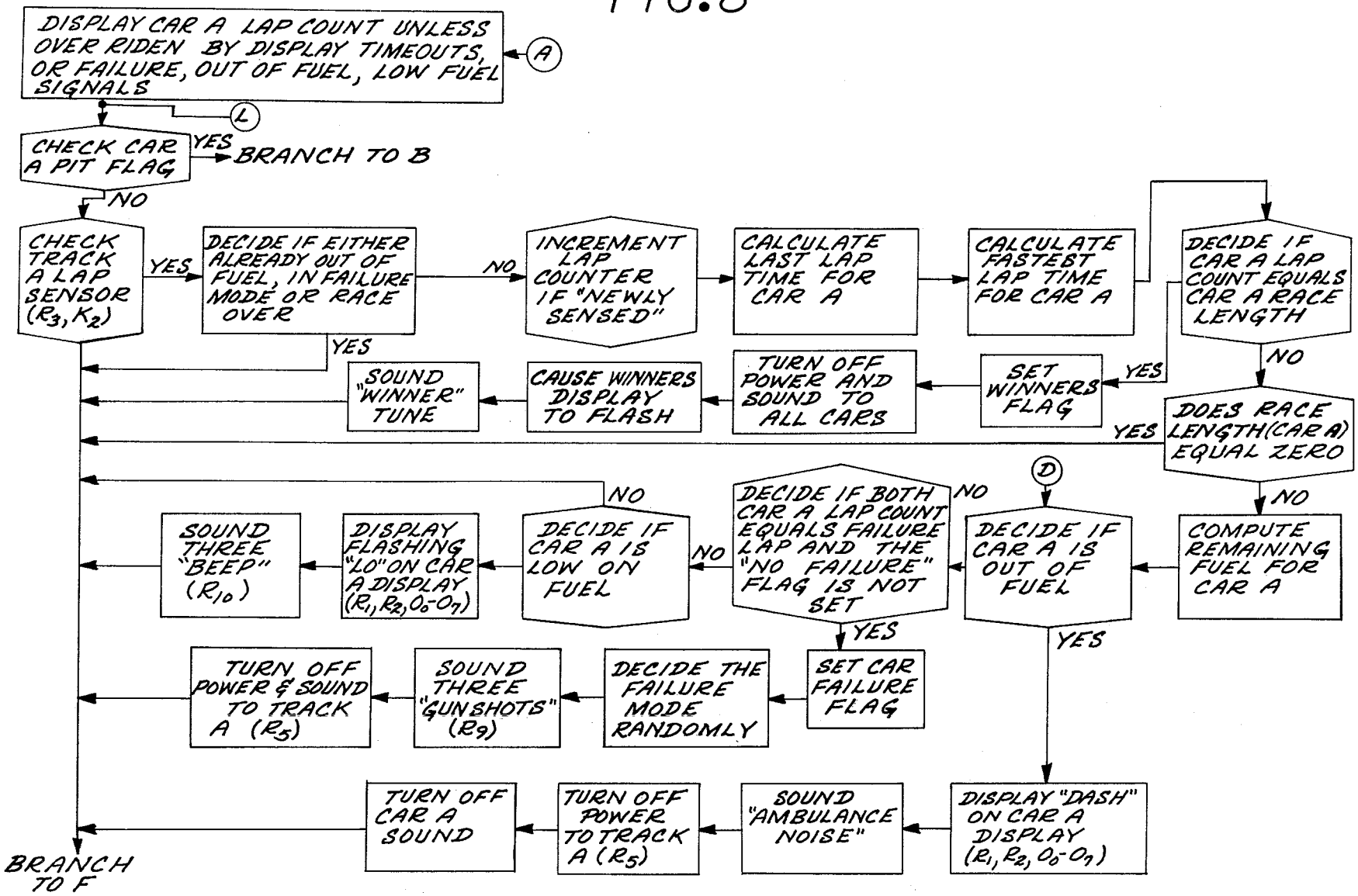
Figure 9:
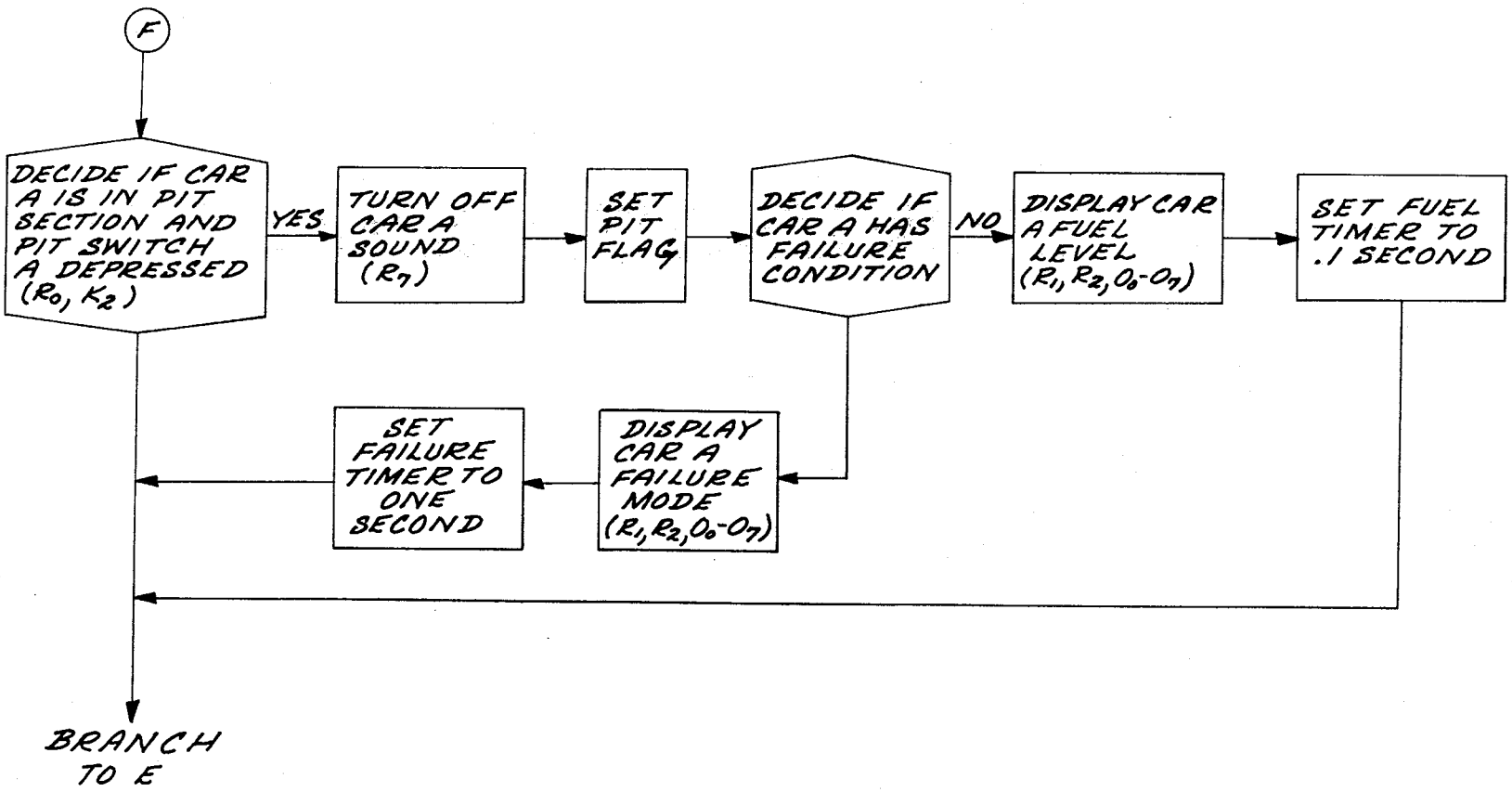
Figure 11:
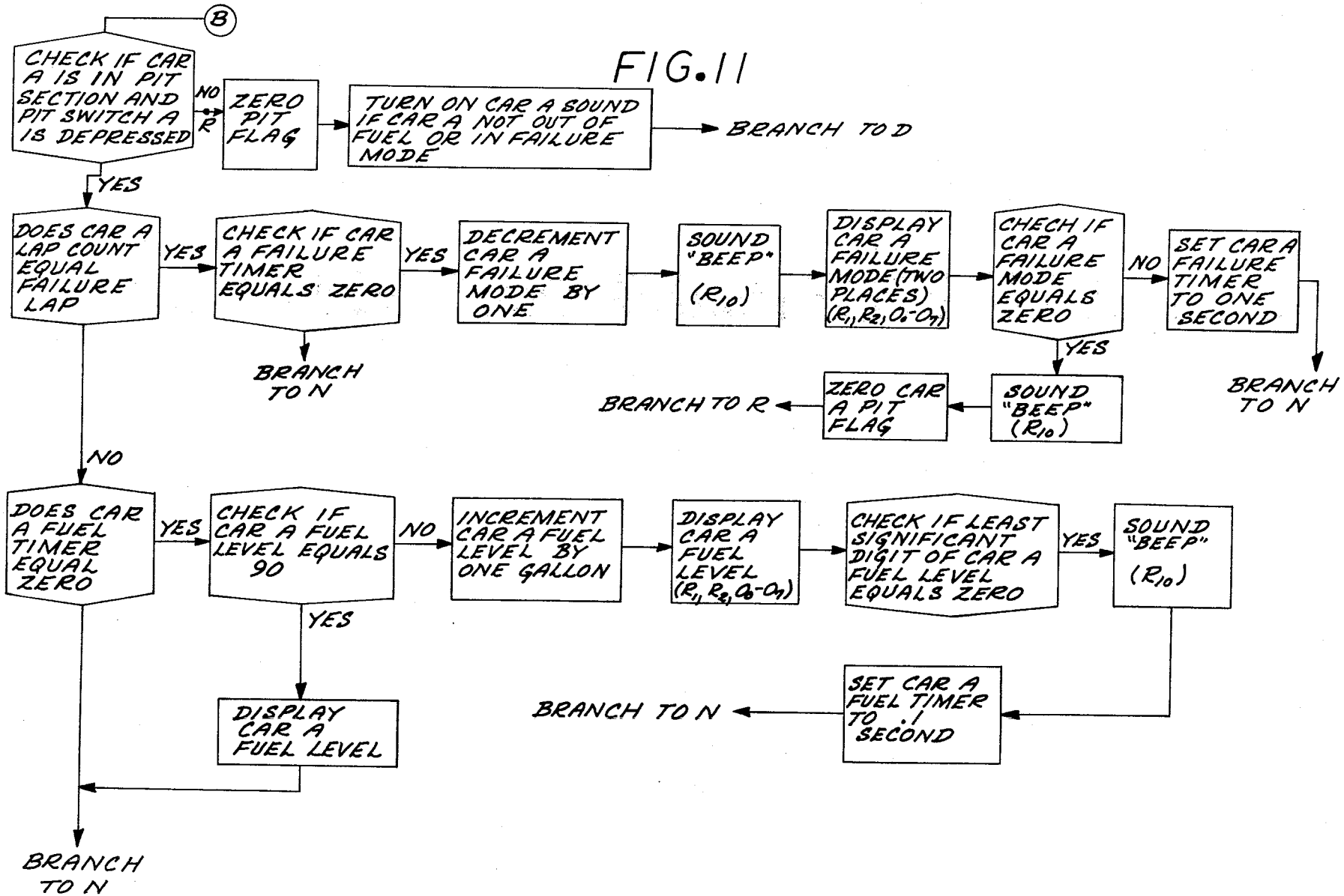

Referring now to FIG. 8, at point A, the pit flag for checked, and if "high", the next step, at "A", is to display the car A count, unless the display of other information overrides the lap count display. This will occur when the timeouts for display of fuel and lap time information have not ended, or when the display is displaying failure, out of fuel or low fuel conditions. Next, the car A pit flag is checked, and if "high", the program branches to "B" (FIG. 11). If the pit flag is "low", the track A lap sensor is checked to determine if car A is on the section, and if so, a decision is made as to whether car A is either already out of fuel, in a failure mode, or the race is over. If any one of these conditions is true, the program continues to point F (FIG. 9). If none of the conditions are true, the lap counter for car A is incremented if the car is newly sensed, i.e. if it left the lap sensor section 83 after the last lap incrementation, and the last lap time and the fastest lap times for car A are calculated.

A decision is then made to determine if car A has won the race; if so, a "winner's" flag is set, the engine sound and power to both cars is turned off, the display of the winner's car flashes and the winner's tune, the familiar "charge", is sounded, the program continuing on to point F (FIG. 9).

If the car A lap count did not equal its race length, a decision is made as to whether the race length for car A equals zero (i.e. no race length was set prior to "start"). If so, the program continues to point F. If not, the remaining fuel is calculated in accordance with the formula previously set forth hereinabove. It is then decided whether car A is out of fuel, and if so, a "—" is displayed in the car A display, the power to track A is turned off, and the car A engine sound will be turned off. If car A is not out of fuel, a decision is made as to whether both the car A lap count equals the previously set failure lap, and the "no failure" flag is not set. (No failures will be determined unless the power/failure display module is connected). If the decision is yes, the car A failure flag is set, the failure mode determined randomly, three "gunshots" are sounded, and the power and engine sound for car A turned off. If the decision is "no", another decision is made to determine if car A is low on fuel (i.e. a fuel level of 18 gallons or less). If not, the program continues to point F. If car A is low on fuel, the display for car A will show flashing "LO", and three "beeps" will be sounded as a low fuel warning, the program continuing to point F.

Figure 10:
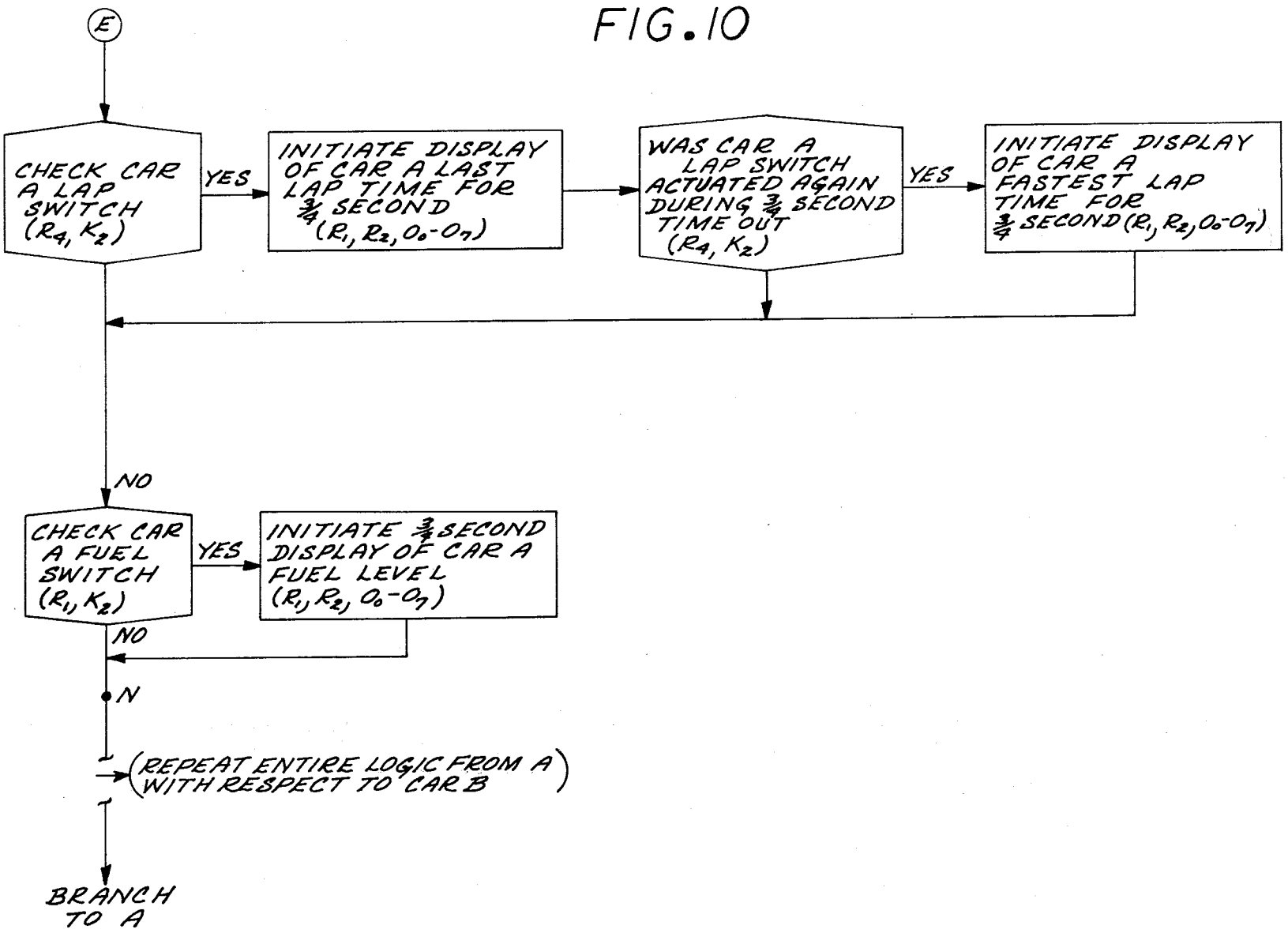

Referring now to FIG. 9, at point F, a decision is made to determine if the car A pit switch is activated and car A is in the pit track section. If so, the car A engine sound is turned off, and the car A pit flag is set. A decision is then made to determine if car A is in a failure condition (by checking the failure flag). If not, the car A fuel level is displayed, the car A fuel timer set to 0.1 sec and the program continues to point E (FIG. 10). If the car is in a failure condition, the car A failure mode is displayed, the car A failure timer set to one second, and the program continues to point E.

Referring now to FIG. 10, at E, the car A lap switch is checked, and if actuated, the car A display of last lap time for $\frac{3}{4}$ second is initiated. Next, a determination is made as to whether the car A lap switch was actuated again during the $\frac{3}{4}$ second timeout, and if so, the car A fastest lap time is displayed for $\frac{3}{4}$ second. The program continues to check the car A fuel switch (similarly, if the car A lap switch was not activated during the $\frac{3}{4}$ timeout, the program proceeds to check the car A fuel switch).

If the car A fuel switch is actuated, a $\frac{3}{4}$ second display of the car A fuel level is initiated, the program returning to point N.

With the exception of the point B logic, previously referred to in FIG. 8, this completes the main program, and the program branches back to point A to reiterate the sequence.

Referring now to FIG. 11, at point B, a check is made to determine if car A is in the pit section and that the car A pit switch is actuated. If not, the car A pit flag is zeroed, and the program branches to point D (FIG. 8). If the car is in the pit section and the car A pit switch is actuated, it is next determined whether the car A lap count equals the failure lap (previously set). If so, the car A failure timer is checked to determine whether it now equals zero, and if not, the program branches to point N. (FIG. 10). If yes, the failure timer is zero, the car A failure mode is decremented by one, a "beep" is sounded, and the car A failure mode displayed both on the car A display and the failure display and the failure display board.

Next, it is determined whether the car A failure mode equals zero, and if not, the car A failure timer is set at one second and the program branches to point N. If the failure mode is zero, a "beep" is sounded, the car A pit flag is zeroed, and the program branches to R.

If the car A lap count does not equal the failure lap, the car A fuel timer is checked to determine whether it is zero. If so, a check is made to see if the car A fuel level equals 90; if yes, the car A fuel level is displayed and the program branches to point N. If the fuel level does not equal 90, the fuel level is incremented by one gallon, and the fuel level displayed. If the least significant digit of the fuel level is zero, a "beep" is sounded. The car A fuel timer is reset to 0.1 sec and the program branches to point N.

It is noted that the timers utilized by the program may well be software derived, e.g. constituting simple counters to count the number of iterations of the program and, based upon the computed average elapsed time per iteration, compute an elapsed time in accordance with the average iteration duration and the number of iterations. While this is not absolutely accurate, the accuracy is sufficient for the present application.

This completes the discussion on the program flowchart shown in FIGS. 7 through 11. As will be apparent to those skilled in the art, certain changes and modifications in the program shown may be made within the spirit and scope of the present invention. For example, the priorities of checking the individual switches is relatively unimportant, except that the lap sensor is generally the highest priority input to the microcomputer, and so the priority of checking the other sensors may be changed.

A novel and unique roadrace system has been disclosed which provides for electronically controlled race conditions and parameters, and which provides information to the operators by both visual and auditory means. In particular, the novelty and enjoyment of the game is considerably enhanced by the system's ability to provide sounds in dependance upon the race conditions, such as race start "gunshots" and a winner's tune, as well as the various failure indications.

Various other changes to the program, the schematic drawings, and the preferred embodiment in general, may be made by those skilled in the art and still be included within the spirit and scope of the present invention.

What is claimed is:

1. A roadrace system for racing toy electrically powered cars over a defined course under operator control, comprising:

a track means for defining the path of travel for the toy car and providing it with driving power, said track means having a section thereof that is electrically independent of the remaining track and does not provide power to the toy car, and electronic control means responsive to the toy car contacting the electrically independent section of said track means for causing information to be conveyed to the operator.

2. The roadrace system of claim 1 wherein said control means comprises:

a master control means responsive to the toy car contacting the electrically independant section of said track means for determining what information is to be conveyed; and a visual display means for visually displaying the information determined by the master control means.

3. The roadrace system of claim 2 wherein said master control means determines the number of laps the toy car has travelled.

4. The roadrace system of claim 2 wherein said master control means determines fuel level for the toy car.

5. The roadrace system of claim 2 wherein said master control means determines last lap time for the toy car.

6. The roadrace system of claim 2 wherein said master control means determine fastest lap time for the toy car.

7. The roadrace system of claim 2 wherein said master control means determines end of the race.

8. The roadrace system of claim 1 wherein said control means comprises:

a master control means responsive to the toy car contacting the electrically independant section of said track means for determining what information is to be conveyed; and a sound generator means for audibly conveying certain information determined by the master control means.

9. The roadrace system of claim 8 wherein said sound generator means is adapted for audibly conveying two or more different sounds in dependance upon certain information determined by the master control means.

10. The roadrace system of claim 9 wherein said sound generator means is adapted to provide a first sound signal indicative of the race start, and a second sound signal indicative of the race finish.

11. The roadrace system of claim 1, further comprised of a sound generator means coupled to said track means for producing sounds in dependance upon the voltage level applied to said track means.

12. A roadrace system for racing toy electrically powered cars over a defined course under operator control, comprising:

a track means for defining the path of travel for the toy car and providing it with driving power, said track means having a section thereof that is selectively electrically independant;

means for selectively electrically disconnecting said section from the track means; and a control means responsive to the toy car contacting the selectively electrically independant section and said disconnecting means being actuated for causing information to be conveyed to the operator.

13. The roadrace system of claim 12, wherein said control means comprises:

a master control means responsive to the toy car contacting the electrically independant section and said disconnecting means being actuated for determining what information is to be conveyed; and a visual display means for visually displaying the information determined by the master control means.

14. The roadrace system of claim 13 wherein said master control means determines the progress of a pit function being performed on the toy car.

15. The roadrace system of claim 13 wherein said master control means further randomly selects from a plurality of predetermined failures to assign such selected failure to the toy car.

16. The roadrace system of claim 12, further comprising a power/failure means responsive to said master control module means for disconnecting power to the track means.

17. The roadrace system of claim 16, wherein said control module means randomly selects from a plurality of predetermined failures and assigns such selected failure to the toy car, including actuating the power/failure module means for disconnecting power to the track means and causing failure information to be conveyed to the operator.

18. The roadrace system of claim 17, wherein said control means comprises:

a master control means responsive to the toy car contacting the electrically independant section and said disconnecting means being actuated for determining what information is to be conveyed; and a visual display means for visually displaying the information determined by the master control means.

19. The roadrace system of claim 18 wherein said control means determines the progress of a pit-stop function and deactivates the power/failure module means when the pit-stop function is completed.

20. The roadrace system of claim 12 wherein said control means comprises:

a master control means responsive to the toy car contacting the electrically independant section of said track means for determining what information is to be conveyed; and a sound generator means for audibly conveying certain information determined by the master control means.

21. The roadrace system of claim 20 wherein said sound generator means is adapted for audibly conveying two or more different sounds in dependance upon certain information determined by the master control means.

22. The roadrace system of claim 21 wherein said sound generator means is adapted to provide certain sound signals indicative of the pit function being performed on the car.

23. The roadrace system of claim 12, further comprised of a sound generator means coupled to said track means for producing sound in dependance upon the voltage level applied to said track means.

24. A roadrace system for racing toy electrically powered cars over a defined course under operator control, comprising:

a track means for defining the path of travel for the toy car and providing it with driving power;

means for sensing the presence of the toy car at a particular section of the track means;

a control means responsive to said sensing means for determining and causing audio race condition information to be conveyed to the operator; and sound generator means controlled by said control means for audibly conveying information to the operator.

25. The roadrace system of claim 24 wherein the start of the race is announced to the operator by a first sound signal from the sound generator.

26. The roadrace system of claim 24 wherein the end of the race is announced to the operator by a second sound signal from the sound generator.

27. The roadrace system of claim 24 wherein said control means determines fuel level for the toy car and announces a low fuel indication by a third sound signal, and an out of fuel indication by a fourth sound signal from said sound generator.

28. A roadrace system for racing toy electrically powered cars over a defined course under operator control, comprising:

a track means for defining the path of travel for the toy car and providing it with driving power;

means for sensing the presence of the toy car at a particular section of the track means;

a control means responsive to said sensing means for causing information to be conveyed to the operator regarding a pit-stop function being performed on the toy car while located at the particular section of the track means; and operator activated switch means for causing said control means to respond to said sensing means.

29. The roadrace system of claim 28 wherein said control means comprises:

a master control means responsive to the presence of said toy car at said particular section of the track means for determining what information is to be conveyed; and a sound generator means for audibly conveying certain information determined by the master control means.

30. The roadrace system of claim 29 wherein said sound generator means is adapted for audibly conveying more than one different sound in dependance upon certain information determined by the master control means.

31. The roadrace system of claim 30 wherein said control means randomly selects from a plurality of predetermined failures and assigns such selected failure to the toy car, causing failure information to be conveyed to the operator.

32. The roadrace system of claim 31 wherein said sound generator means is adapted to provide certain sounds in in dependance upon the said assigned failure.

33. The roadrace system of claim 32 wherein said control means determine the progress of pit stop functions being performed on the toy car, and said sound generator produces certain sound signals in dependance upon said progress.

34. A roadrace system for racing toy electrically powered cars over a defined course under operator control, comprising:

track means for defining the path of travel for the toy car and providing it with driving power;

means for sensing the presence of the toy car at a first section of the track means;

means for sensing the presence of the toy car at a second section of said track;

control means responsive to said sensing means for causing information to be conveyed to the operator, including information regarding a pit-stop function being performed on the toy car while located at said second section of said track means; and means for performing said pit-stop function.

35. A roadrace system for racing toy electrically powered cars over a defined course under operator control, comprising:

a track means for defining the path of travel for the toy car and providing it with driving power;

means for sensing the presence of the toy car at a particular section of the track means; and a control means responsive to said sensing means for causing information to be conveyed to the operator regarding a pit-stop function being performed on the toy car while located at the particular section of the track means; and means for performing said pit-stop function.

36. A roadrace system for racing toy electrically powered cars over a defined course under operator control, comprising:

a track means for defining the path of travel for the toy car and prividing it with driving power;

means for sensing the presence of the toy car at a particular section of the track means;

a control means responsive to said sensing means for causing information to be conveyed to the operator regarding a pit-stop function being performed on the toy car while located at the particular section of the track means; and power/failure means responsive to said control means for disconnecting power to the track means.

37. The roadrace system of claim 36 wherein said control means randomly selects from a plurality of predetermined failures and assigns such selected failure to the toy car, including actuating the power/failure module means and causing failure information to be conveyed to the operator.

38. The roadrace system of claim 36 wherein said control means determines the fuel level of the car in dependance upon laps completed and car velocity.

39. The roadrace system of claim 38 wherein said control means actuates the power/failure module means upon determining that the toy car is out of fuel, and causing out-of-fuel indications to be conveyed to the operator.

* * * * *

UNITED STATES PATENT AND TRADEMARK OFFICE

CERTIFICATE OF CORRECTION

PATENT NO. : 4,247,107

DATED : January 27, 1981

INVENTOR(S) : Jay Smith, III, Lawrence T. Jones, Gerald S. Karr, Thomas H. Grimm It is certified that error appears in the above—identified patent and that said Letters Patent is hereby corrected as shown below:

Column 4, line 11, delete "in" and insert --on--.

Column 11, line 22, delete "0.2" and insert --0.1--.

Column 14, line 29, delete " " " ", and insert --"═══" --.

Signed and Sealed this

*Eighteenth* Day of *August 1981*

[SEAL]

*Attest:*

GERALD J. MOSSINGHOFF

*Attesting Officer*

*Commissioner of Patents and Trademarks*